US012454946B2

(12) United States Patent
Wu

(10) Patent No.: US 12,454,946 B2
(45) Date of Patent: Oct. 28, 2025

(54) PORTABLE AIR PUMP

(71) Applicant: Scott Wu, Taichung (TW)

(72) Inventor: Scott Wu, Taichung (TW)

( * ) Notice: Subject to any disclaimer, the term of this patent is extended or adjusted under 35 U.S.C. 154(b) by 349 days.

(21) Appl. No.: 18/318,821

(22) Filed: May 17, 2023

(65) Prior Publication Data

US 2024/0384713 A1 Nov. 21, 2024

(51) Int. Cl.
*F04B 33/00* (2006.01)

(52) U.S. Cl.
CPC ..... *F04B 33/005* (2013.01); *F04B 33/00* (2013.01)

(58) Field of Classification Search
CPC ..... F04B 33/005; F04B 33/00; B60S 5/04
See application file for complete search history.

(56) References Cited

U.S. PATENT DOCUMENTS 5,494,411 A * 2/1996 Chuang ..... F04B 33/00 92/58.1
6,464,477 B1 * 10/2002 Wu ..... F04B 33/005 92/58.1
7,681,489 B2 * 3/2010 Wu ..... F04B 33/005 92/58.1
7,931,451 B2 * 4/2011 Wu ..... F16L 27/04 417/234
2003/0039553 A1 * 2/2003 Wang ..... F04B 33/005 417/63
2013/0028756 A1 * 1/2013 Wang ..... F04B 33/005 417/234
2013/0071264 A1 * 3/2013 Wang ..... F04B 33/005 417/234
2021/0277878 A1 * 9/2021 Wu ..... F16K 15/20

* cited by examiner

*Primary Examiner* — Dominick L Plakkoottam
(74) *Attorney, Agent, or Firm* — Muncy, Geissler, Olds & Lowe, P.C.

(57) ABSTRACT

A portable air pump includes an inflating mechanism, a joint seat disposed on a cylinder of the inflating mechanism, a support seat pivotally coupled to the joint seat, a positioning mechanism pivotally coupled to the support seat, and a footrest is coupled to the support seat. The joint seat has a joint end including a positioning portion and a groove. The support seat includes a connection pivotally received by the groove and has a receptacle. The positioning mechanism includes a positioning member pivotally engaged in the receptacle and a biasing member. The positioning member is biased by the biasing member and detachably engagable with the positioning portion. The footrest is folded out when the positioning member is engaged with the positioning portion and adapted to be folded toward the inflating mechanism when the positioning member is disengaged from the positioning portion.

16 Claims, 6 Drawing Sheets

PORTABLE AIR PUMP

BACKGROUND OF THE INVENTION

The present invention relates to a portable air pump and, more particularly, to a portable pump including a foot pedal which is movable to different angular positions for different purposes.

Portable air pumps usually have a compact shape for easy portability. However, it becomes laborious and complicate to assemble many smaller-sized components of a portable air pump, and inconvenient to operate the portable air pump. For example, 1) portable air pumps usually do not have an easy readable pressure gauge, 2) the connection between an air nozzle of the potable air pump and a valve of a tire of a bike is easily obstructed by external objects such as rim spokes, 3) a difficulty to read a pressure value after the air nozzle is connected to the tire, and 4) it is tiring to inflate the tire when a user holds a cylinder of the portable pump with one hand and hold a handle of the portable pump with the other hand.

The present invention is, therefore, intended to obviate or at least alleviate the problems encountered in the prior art.

SUMMARY OF THE INVENTION

A portable air pump includes an inflating mechanism including a cylinder, a joint seat arranged at an end of the cylinder, a support seat pivotally coupled to the joint seat, a positioning mechanism pivotally coupled to the support seat, and a footrest is arranged on a side of the support seat. The joint seat has a joint end including a first positioning portion and a groove. The support seat includes a connection pivotally received by the groove and has a receptacle. The positioning mechanism includes a positioning member pivotally engaged in the receptacle and a biasing member arranged between a surface of the receptacle and the positioning member. The positioning member is biased by the biasing member and detachably engagable with the first positioning portion such that the joint seat and the support seat are restrained from pivoting relative to each other. The footrest is folded out when the positioning member is engaged with the first positioning portion and adapted to be folded toward the inflating mechanism when the positioning member is disengaged from the first positioning portion.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components assembly forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for designing of other structures, methods and systems for carrying out the several purposes of the present invention. It is important, therefore, that the claims be regarded as including such equivalent constructions insofar as they do not depart from the spirit and scope of the present invention.

Further, the purpose of the abstract is to enable the public generally, and especially scientists, engineers and practitioners in the art who are not familiar with patent or legal terms or phraseology, to determine quickly from a cursory inspection the nature and essence of the technical disclosure. The abstract is neither intended to define the invention, which is measured by the claims, nor is it intended to be limiting as to the scope of the invention in any way.

Other objectives, advantages, and new features of the present invention will become apparent from the following detailed description of the invention when considered in conjunction with the accompanied drawings.

DETAILED DESCRIPTION OF THE INVENTION

Figure 1:
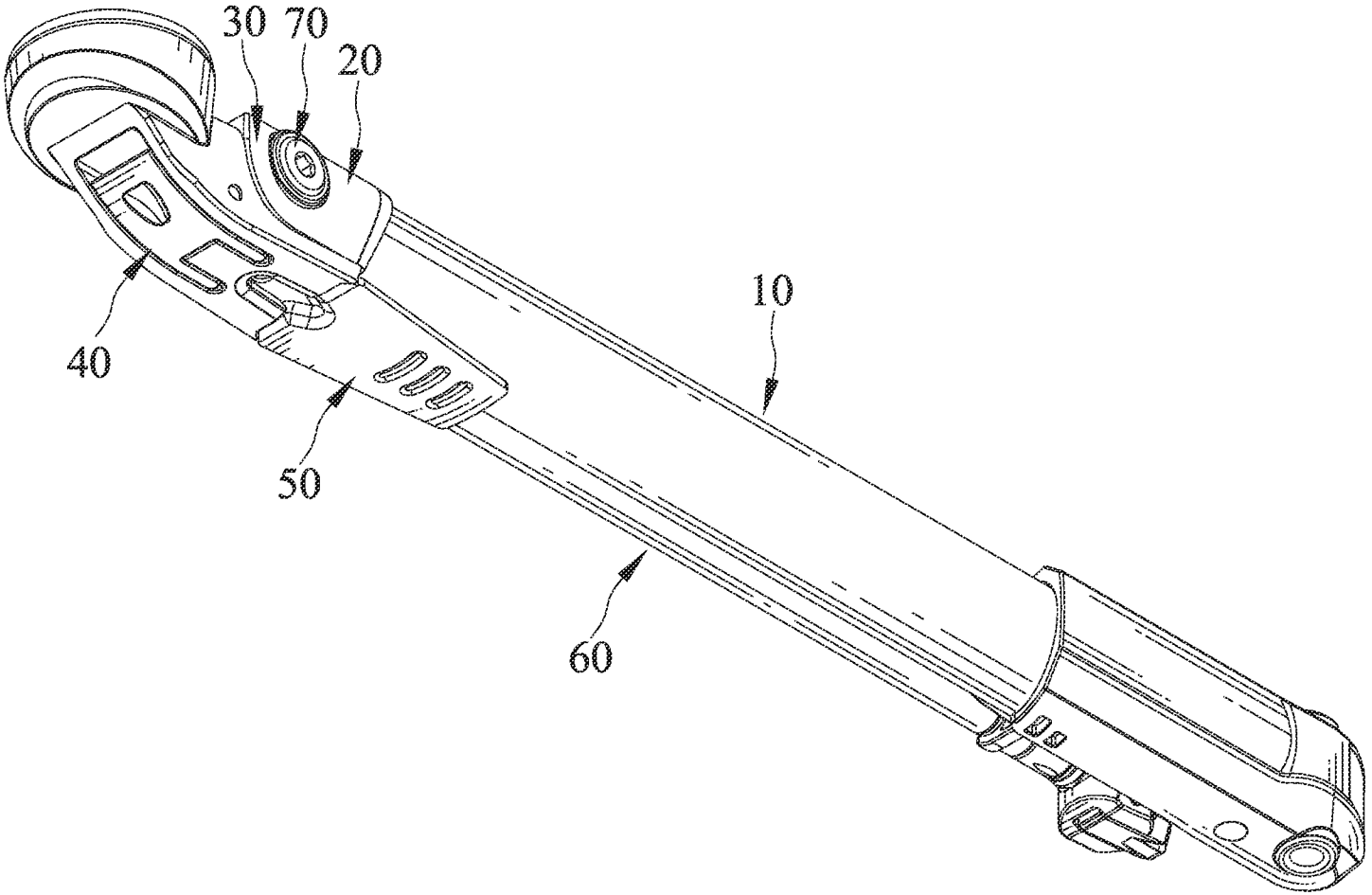
FIG. 1 is a perspective view of a portable air pump according to the present invention.
Figure 2:
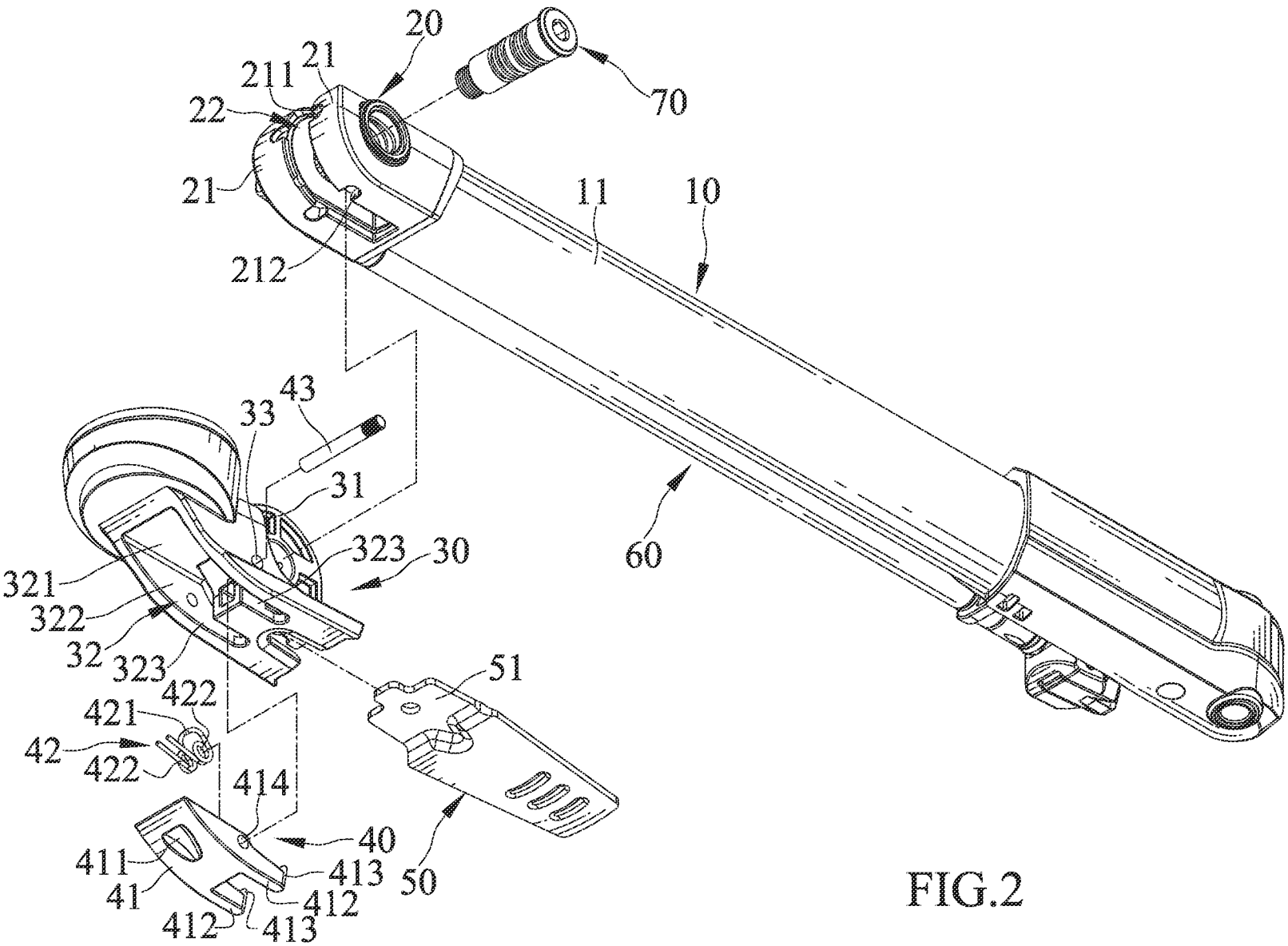
FIG. 2 is an exploded perspective view of the portable air pump of FIG. 1.

FIGS. 1-6 show a portable air pump according to the present invention. The portable air pump includes an inflating mechanism 10, a joint seat 20, a support seat 30, a positioning mechanism 40, a footrest 50, and a joining mechanism 60.

The inflating mechanism 10 includes a cylinder 11 which is adapted to receive a piston (not shown) and store air compressed by the piston.

The joint seat 20 is arranged at an end of the cylinder 11. The joint seat 20 has a joint end 21 in a form including a pair of connections. The joint end 21 includes a first positioning portion 211 and a second positioning portion 212. Each of the first and the second positioning portions 211 and 212 defines two holes, with one hole extending in one of the pair of connections, and with another hole extending in the other of the pair of connections. The second positioning portion 212 is spaced from the first positioning portion 211. The first and the second positioning portions 211 and 212 are spaced from each other along an outer periphery of the joint end 21 at an arc length which subtends an angle of 90 degrees. Moreover, the pair of connections include a groove 22 formed therebetween. The two holes of the respective first and second positioning portions 211 and 212 are disposed on opposite sides of the groove 22.

The support seat 30 is pivotally coupled to the joint seat 20. The support seat 30 includes a connection 31 and has a receptacle 32. The connection 31 is pivotally received by the groove 22. The support seat 30 includes the connection 31 and the receptacle 32 located on a top side and a bottom side thereof respectively. The receptacle 32 has a first receptacle portion 322 and a second receptacle portion 323. The support seat 30 has a first through hole 33 extending transverse to and through the first receptacle portion 322.

The positioning mechanism 40 is pivotally coupled to the support seat 30. The positioning mechanism 40 includes a positioning member 41, a biasing member 42, and a pivot 43. The positioning member 41 is pivotally engaged in the receptacle 32 by the pivot 43 and biased by a biasing member 42. The biasing member 42 is arranged between a surface of the receptacle 32 and the positioning member 41. The biasing member 42 is a torsion spring.

The positioning member 41 has a second through hole 414 aligned and corresponding with the first through hole 33. The biasing member 42 has an abutment portion 421 abutting against the bottom 321 of the receptacle 32 and a receiving portion 422 receiving the pivot 43. The receiving portion 422 is in a form of two loops and located on different sides of the abutment portion 421. The pivot 43 is configured to pivotally connect the positioning member 41 to the support seat 30. The pivot 43 is inserted in the first through hole 33, through the biasing member 42, and in the second through hole 414. The pivot 43 is inserted through the receiving portion 422.

The positioning member 41 is detachably engagable with the first or the second positioning portions 211 and 212 such that the joint seat 20 and the support seat 30 are restrained from pivoting relative to each other. The joint seat 20 and the support seat 30 are angled at a first angle when the positioning member 41 is engaged with the first positioning portion 211 and at a second angle when the positioning member 41 is engaged with the second positioning portion 212.

The positioning member 41 has an actuating end 411 usable for pivoting the positioning member 41 and a positioning end 412 configured for selectively engaging with the first and the second positioning portions 211 and 212. The first receptacle portion 322 is adapted to receive the actuating end 411 and the second receptacle portion 323 is adapted to receive the positioning end 412, respectively. The actuating end 411 is spaced from and movable toward and away from a bottom 321 of the receptacle 32. The positioning end 412 extends from the actuating end 411 and is in a form including a pair of ears, and each of the pair of ears has an engaging portion 413 configured to detachably engage with the first and the second positioning portions 211 and 212.

The footrest 50 is arranged on a side of the support seat 30. The support seat 30 has a hold end 34 at an end and the footrest 50 has a fixed end 51 engaged with the hold end 34 of the support seat 30. The footrest 50 is folded out when the positioning member 41 is engaged with the first positioning portion 211 and adapted to be folded toward the inflating mechanism 10 when the positioning member 41 is disengaged from the first positioning portion 211. Thus, when the positioning member 41 is engaged with the first positioning portion 211, the footrest 50 is folded out, and the inflating mechanism 10 and the footrest 50 include a space therebetween adapted to allow a user to stand on the footrest 50 when operating the portable air pump.

The joining mechanism 60 is configured to connect an object to be inflated to the portable air pump. The joining mechanism 60 is pivotally connected to the joint seat 20. The joint end 21 of the joint seat 20 and the connection 31 of the support seat 30 include a shaft connector 70 inserted therein. The joining mechanism 60 is connected to the shaft connector 70.

Figure 3:
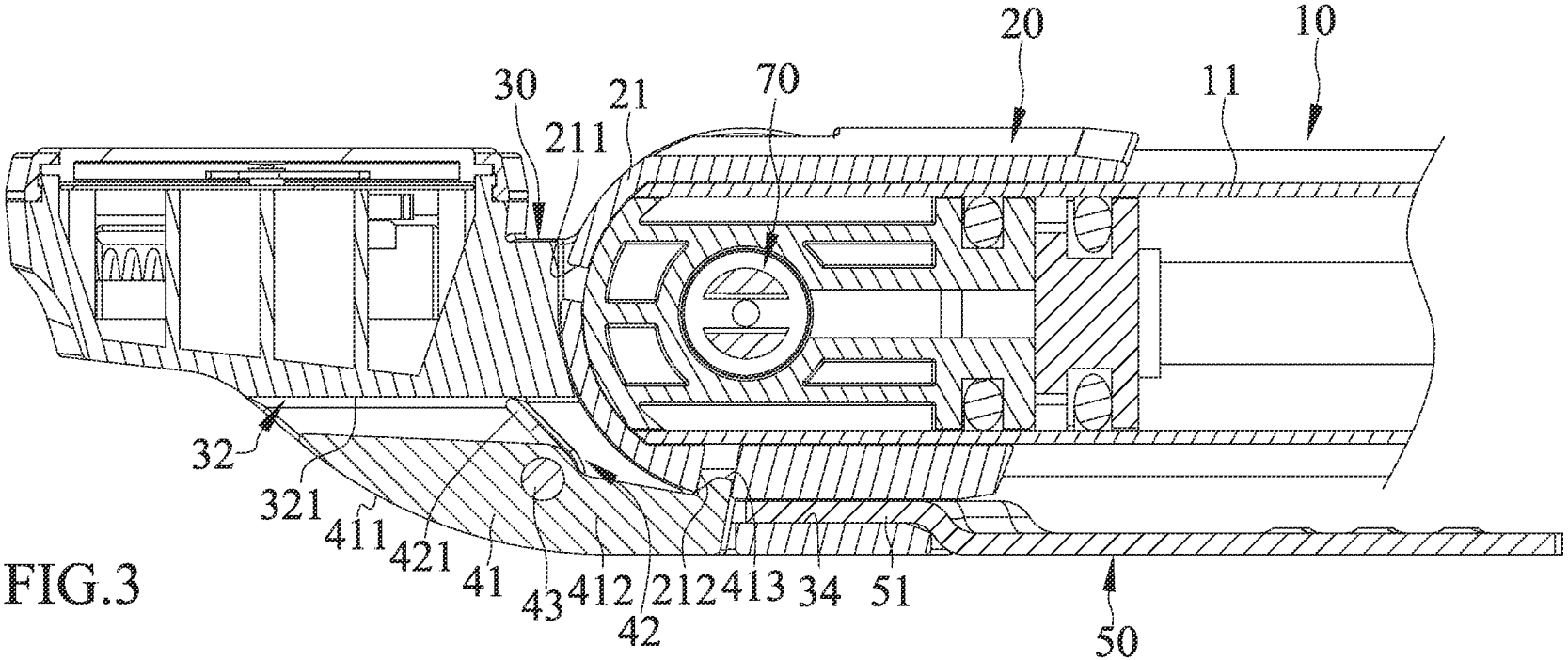
FIG. 3 is a cross-sectional view of the portable air pump of FIG. 1 in a compact configuration.

FIG. 3 shows that the portable air pump in a compact configuration in which the engaging portion 413 of the positioning member 41 is engaged with the second positioning portion 212 of the joint end 21, the joint seat 20 and the support seat 30 are prevented from pivoting relative to each other, and the footrest 50 extend along the cylinder 11, i.e. the footrest and the cylinder extend parallel to each other. As such, the portable air pump is compact and easy to carry.

Figure 4:
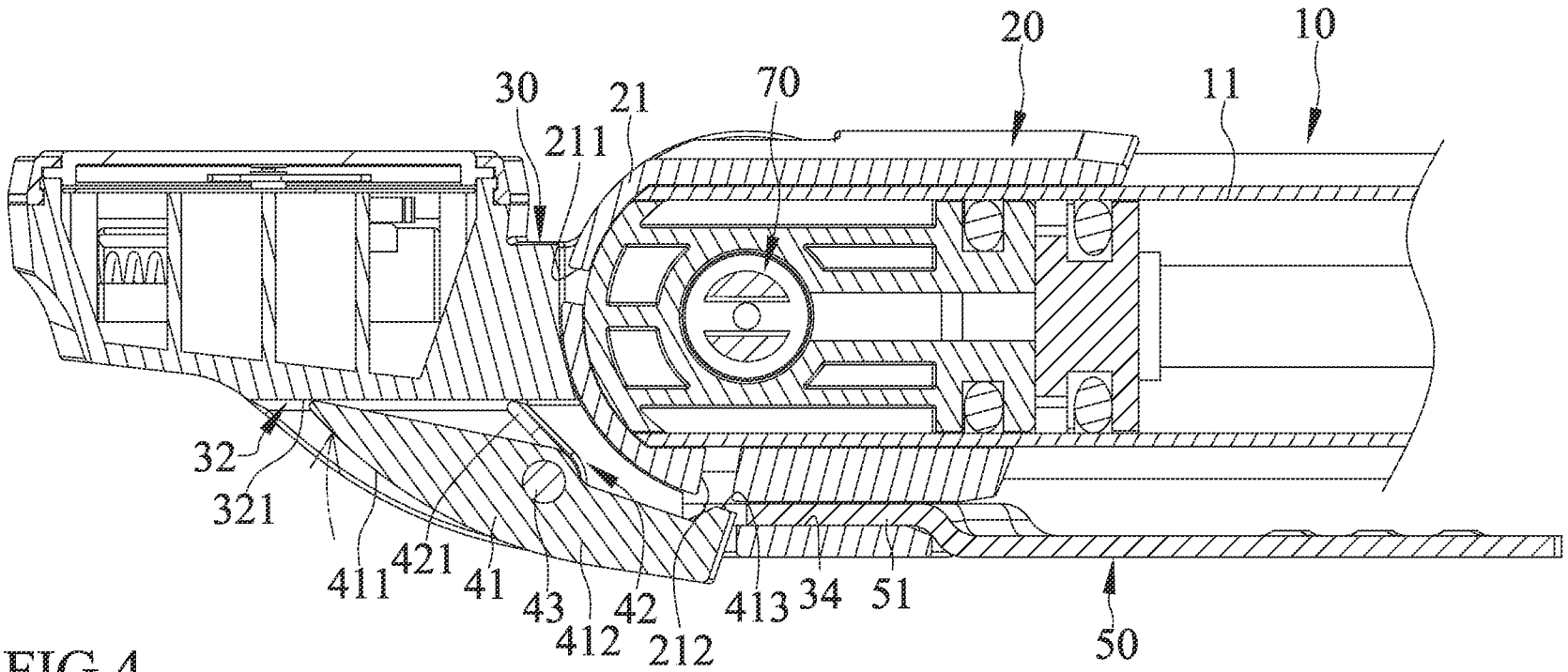
FIG. 4 is a cross-sectional view showing the portable air pump of FIG. 1 including a positioning mechanism in an unlocked position.
Figure 5:
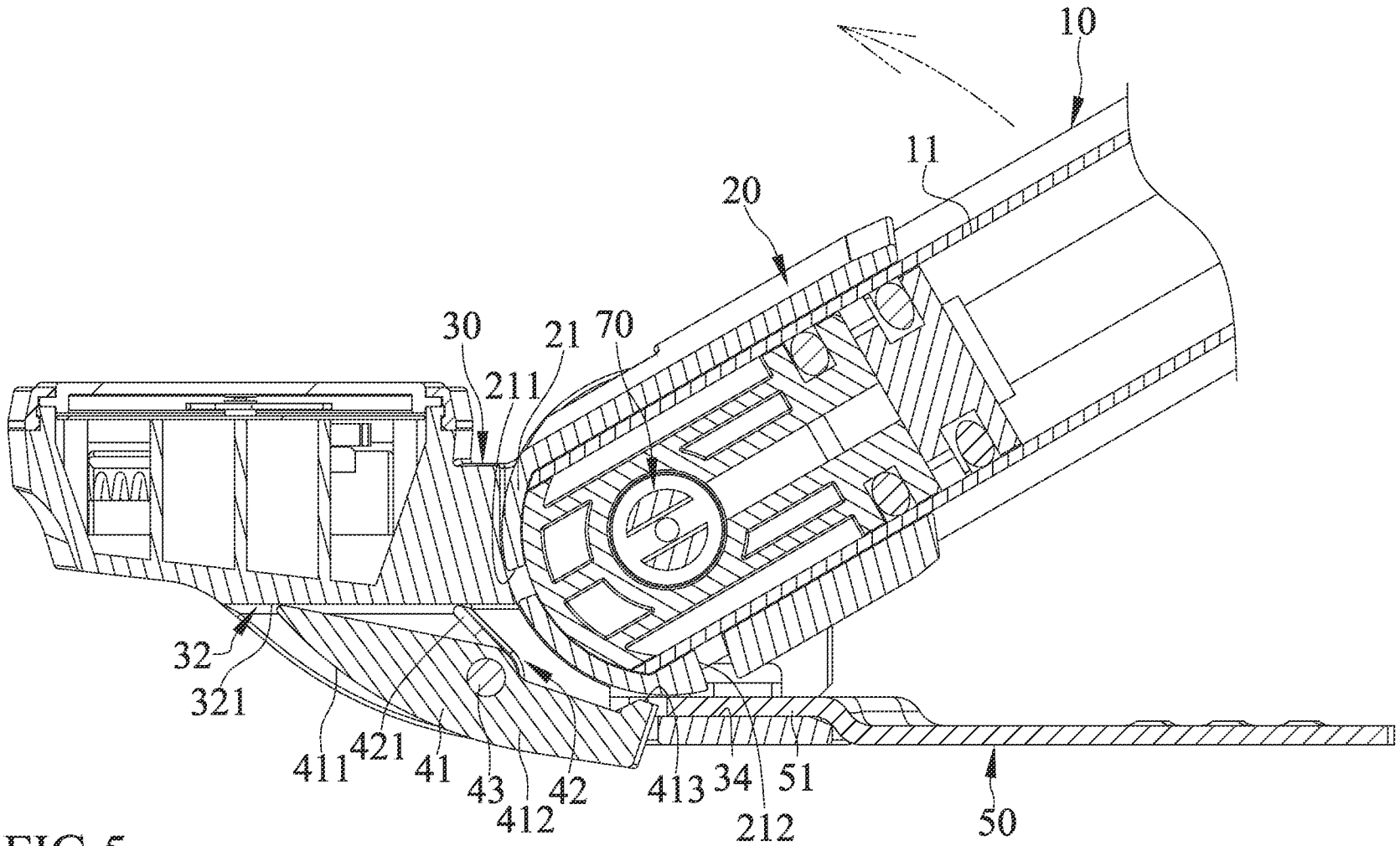
FIG. 5 is a cross-sectional view showing the portable air pump of FIG. 1 including a joint seat and a support seat operably pivotal relative to each other when the positioning mechanism in an unlocked position.

FIG. 4 shows that a force greater than the restoring force of the biasing member 42 is applied on the positioning member 41 in order to pivot the positioning member 41 to a position in which the actuating end 411 approaches the bottom 321 of the receptacle 32, the positioning end 412 is slightly disposed outside the receptacle 32, and the engaging portion 413 of the positioning member 41 is disengaged from the second positioning portion 212 of the joint end 21. When the engaging portion 413 is disengaged from the second positioning portion 212, the joint seat 20 and the support seat 30 are able to be pivoted relative to each other to a relative angular position different from that of FIG. 4, as shown in FIG. 5.

Figure 6:
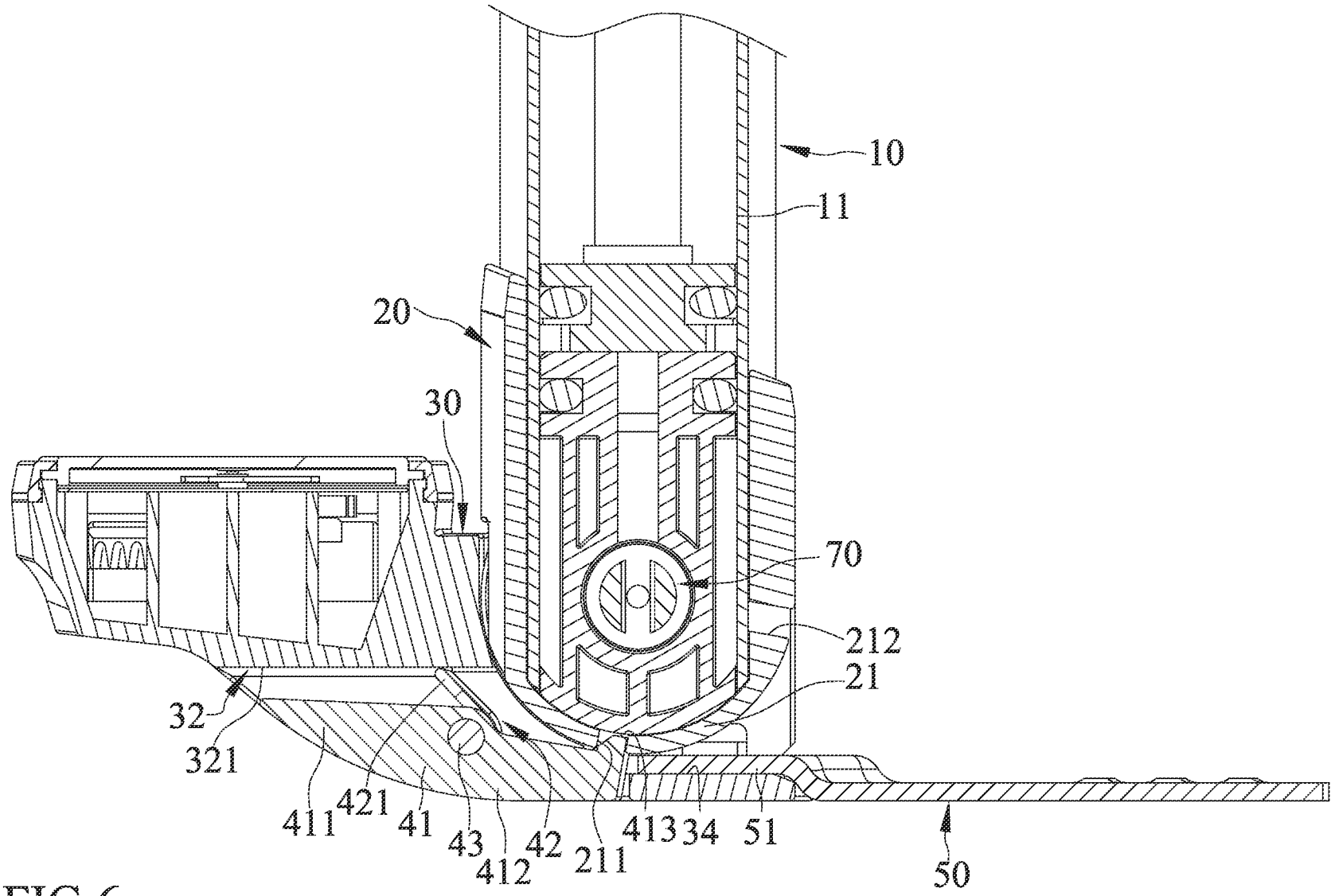
FIG. 6 is a cross-sectional view showing the portable air pump of FIG. 1 including a footrest in a use configuration.

FIG. 6 shows that the joint seat 20 is pivoted relative to the support seat 30 to a position such that the engaging portion 413 of the positioning member 41 is engaged with the first positioning portion 211 under the biasing force of the biasing member 42. When the engaging portion 413 of the positioning member 41 and the first positioning portion 211 of the joint end 21 are engaged, the joint seat 20 and the support seat 30 cannot pivot relative to each other, the portable air pump is in a use position, and the inflating mechanism 10 is disposed orthogonal to the footrest 50. In this regard, the footrest 50 and the air cylinder 11 are arranged in an inverted T shape, and the user can step on the footrest 50 and apply forces to the inflating mechanism 10 with both hands as using a floor pump. In addition, the latching relationship between the engaging portion 413 and the first positioning portion 211 prevents unexpected relative pivoting between the joint seat 20 and the support seat 30 from affecting an inflation operation.

In view of the foregoing, the positioning member 41 is selectively engaged with the positioning portions 211 and 212 of the on the joint seat 21, such that the portable pump is selectively positioned at the use configuration and the compact configuration, and the footrest 50 is adapted to be angled relative to the cylinder 11 for different purposes. In addition, when the positioning member 41 is engaged with either of the first and the second positioning portions 211 and 212 of the joint seat 20, the joint seat 20 and the support seat 30 are prevented inadvertent pivotal movements, thereby the user will not suffer unexpected relative pivotal movement between the joint seat 20 and the support seat 30 when carrying out an inflation operation.

Although specific embodiments have been illustrated and described, numerous modifications and variations are still possible without departing from the scope of the invention. The scope of the invention is limited by the accompanying claims.

The invention claimed is:

1. A portable air pump comprising:

an inflating mechanism including a cylinder;

a joint seat arranged at an end of the cylinder, wherein the joint seat has a joint end including a first positioning portion and a groove;

a support seat pivotally coupled to the joint seat, wherein the support seat includes a connection pivotally received by the groove and has a receptacle;

a positioning mechanism pivotally coupled to the support seat, wherein the positioning mechanism includes a positioning member pivotally engaged in the receptacle and a biasing member arranged between a surface of the receptacle and the positioning member, and wherein the positioning member is biased by the biasing member and detachably engagable with the first positioning portion such that the joint seat and the support seat are restrained from pivoting relative to each other; and a footrest arranged on a side of the support seat, wherein the footrest is folded out when the positioning member is engaged with the first positioning portion and adapted to be folded toward the inflating mechanism when the positioning member is disengaged from the first positioning portion.

2. The portable air pump as claimed in claim 1, wherein the joint end further has a second positioning portion with which the positioning member is detachably engagable, wherein the second positioning portion is spaced from the first positioning portion, and wherein the joint seat and the support seat are angled at a first angle when the positioning member is engaged with the first positioning portion and at a second angle when the positioning member is engaged with the second positioning portion.

3. The portable air pump as claimed in claim 1, wherein the positioning member has an actuating end usable for pivoting the positioning member and a positioning end configured for detachably engaging with the first positioning portion, wherein the actuating end is spaced from and movable toward and away from a bottom of the receptacle, and wherein the positioning end extends from the actuating end and is in a form including a pair of ears, and each of the pair of ears has an engaging portion configured to detachably engage with the first positioning portion.

4. The portable air pump as claimed in claim 3, wherein the support seat includes the connection and the receptacle located on a top side and a bottom side thereof respectively, and wherein the receptacle has a first receptacle portion receiving the actuating end and a second receptacle portion receiving the positioning end.

5. The portable air pump as claimed in claim 4, wherein the support seat has a first through hole extending transverse to and through the first receptacle portion, and the positioning member has a second through hole aligned and corresponding with the first through hole, wherein the positioning mechanism includes a pivot configured to pivotally connect the positioning member to the support seat, and wherein the pivot is inserted in the first through hole, through the biasing member, and in the second through hole.

6. The portable air pump as claimed in claim 1, wherein the biasing member is a torsion spring.

7. The portable air pump as claimed in claim 5, wherein the biasing member is a torsion spring.

8. The portable air pump as claimed in claim 6, wherein the biasing member has an abutment portion abutting against the bottom of the receptacle and a receiving portion receiving the pivot, wherein the receiving portion is in a form of two loops and located on different sides of the abutment portion, and wherein the pivot is inserted through the receiving portion.

9. The portable air pump as claimed in claim 2, wherein the first and the second positioning portions are spaced from each other along an outer periphery of the joint end at an arc length which subtends an angle of 90 degrees.

10. The portable air pump as claimed in claim 1, wherein the support seat has a hold end at an end and the footrest has a fixed end engaged with the hold end of the support seat.

11. The portable air pump as claimed in claim 1 further comprising a joining mechanism configured to connect an object to be inflated to the portable air pump pivotally connected to the joint seat, and wherein the joint end of the joint seat and the connection of the support seat include a shaft connector inserted therein, and wherein the joining mechanism is connected to the shaft connector.

12. The portable air pump as claimed in claim 2, wherein the footrest is folded to extend along the inflating mechanism when the positioning member is engaged with the second positioning portion.

13. The portable air pump as claimed in claim 11, wherein when the footrest is in the use position, the inflating mechanism is disposed orthogonal to the footrest.

14. The portable air pump as claimed in claim 3, wherein the first positioning portion defines two holes in which the engaging portions of the pair of ears engage, and wherein the two holes are disposed on opposite sides of the groove.

15. The portable air pump as claimed in claim 2, wherein the positioning member has an actuating end usable for pivoting the positioning member and a positioning end configured for selectively engaging with the first and the second positioning portions, wherein the actuating end is spaced from and movable toward and away from a bottom of the receptacle, and wherein the positioning end extends from the actuating end and is in a form including a pair of ears, and each of the pair of ears has an engaging portion configured to detachably engage with the first and the second positioning portions.

16. The portable air pump as claimed in claim 15, wherein each of the first and the second positioning portions defines two holes in which the engaging portions of the pair of ears engage, and wherein the two holes of the respective first and second positioning portions are disposed on opposite sides of the groove.

* * * * *